United States Patent [19]

Ciampolillo

[11] 4,391,567

[45] Jul. 5, 1983

[54] CORROSION PREVENTING DEVICE FOR A MARINE PROPELLER

[76] Inventor: Dominick Ciampolillo, 5300 95th St., N., St. Petersburg, Fla. 33708

[21] Appl. No.: 259,811

[22] Filed: May 4, 1981

[51] Int. Cl.[3] ..... B63L 1/18

[52] U.S. Cl. ..... 416/146 R; 416/245 A

[58] Field of Search ... 416/142 A, 146 B, 146 R 147 A, 416/147 R, 244 B, 245 A; 440/83; 114/222; 204/147, 196; 285/45, 120, 173, 329, 422, DIG. 24; 403/320; 411/222, 223, 231

[56] References Cited

U.S. PATENT DOCUMENTS

| | | | |
|---|---|---|---|
| 2,067,839 | 6/1937 | Godfrey | 416/146 B |
| 3,591,311 | 7/1971 | Butler | 416/142 A |
| 3,792,938 | 2/1979 | Wilde | 416/146 B |

*Primary Examiner*—Harvey C. Hornsby
*Assistant Examiner*—Michael Knick
*Attorney, Agent, or Firm*—Stanley M. Miller

[57] ABSTRACT

A corrosion preventing device is disclosed for mounting in sea water on an electrically conductive propeller shaft supporting a marine propeller composed of a metal having a first galvanic potential. The propeller is fastened to the shaft by an electrically conductive propeller nut and is in electrical contact therewith. The device includes an annular washer having a generally circular periphery, composed of a metal having a second galvanic potential not greater than the first galvanic potential, with a central hole concentric with the circular axis thereof through which the shaft may fit to enable an electrical conductive mounting proximate to the propeller nut, for serving as an electrolytic cathode of the device. The device further includes a generally toroidal anode having a circular periphery concentric with the axis, composed of a metal having a third galvanic potential greater than the first galvanic potential, cast about the periphery of the annular washer and exposed to the sea water, for serving as an electrolytic, sacrificial anode of the device. In this manner, the galvanic cell formed by the washer cathode and the toroidal anode maintains the propeller at a relative cathodic potential, thereby preventing the corrosion thereof in the sea water. The resultant device is less expensive to make, use and replace than those in the prior art because its component parts require no machining in their manufacture and the device is fastened to the propeller shaft with a simple jam nut.

2 Claims, 11 Drawing Figures

2
4
6
6
7
7'
8
10
10
10
12
12
14
14
14
16
16
16
18
20
20
20
28
30
32
32
32

FIG. 5
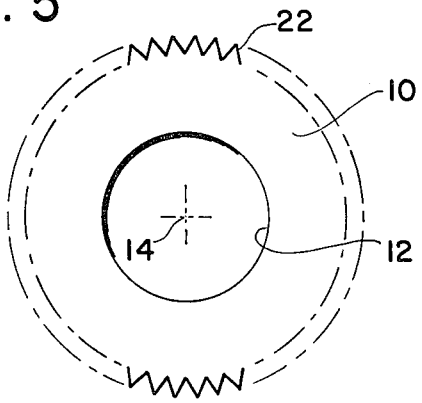
FIG. 6
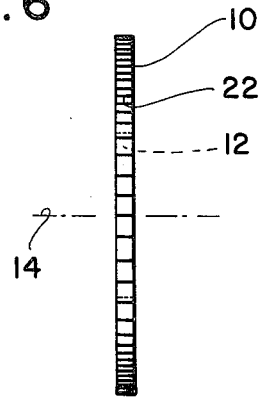
FIG. 10
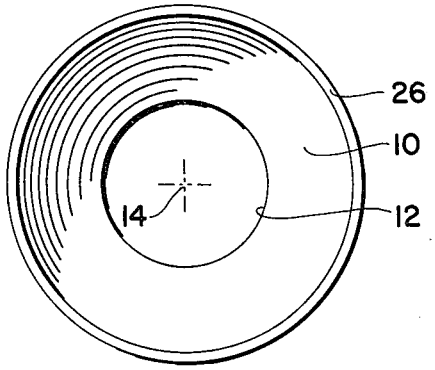
FIG. 11
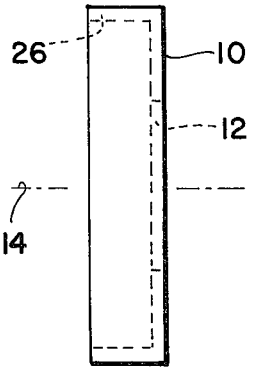
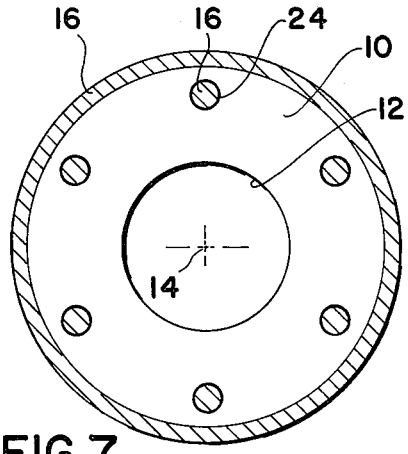
FIG. 7
SECTION 7-7'
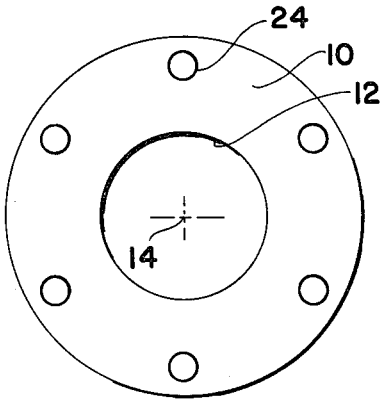
FIG. 8
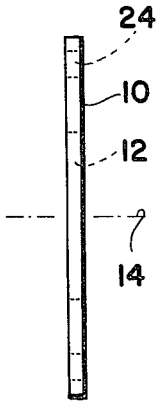
FIG. 9

CORROSION PREVENTING DEVICE FOR A MARINE PROPELLER

FIELD OF THE INVENTION

The invention disclosed broadly relates to marine hardware and more particularly relates to corrosion prevention techniques for marine propellers.

BACKGROUND OF THE INVENTION

As a result of laboratory experiments in salt water, Sir Humphry Davy reported in 1824 that copper could be successfully protected against corrosion by coupling it to iron or zinc. He recommended cathodic protection of copper-sheathed ships, employing sacrificial blocks of iron attached to the hull in the ratio of iron to copper surface of about 1:100. In practice, the corrosion rate of copper sheathing was appreciably reduced, as Davy had predicted. Later, the British successfully protected the iron work of buoys by attaching zinc blocks and in 1840 produced a zinc alloy particularly suited as a sacrificial anode. When wooden hulls were replaced by steel, the fitting of zinc slabs became traditional on all Admiralty vessels. These slabs provided localized protection, especially against the galvanic effects of the bronze propeller.

Brass and bronze hardware on marine propeller assemblies have been provided with a variety of protective devices in the prior art to reduce their electrochemical and galvanic corrosion in sea water. Typically these prior art devices include threaded surfaces in zinc or brass materials which screw onto the propeller shaft proximate to the propeller to be protected. These structures are expensive to manufacture and, since their anodic portions are intentionally designed for sacrificial corrosion, they are even more expensive to use and replace.

OBJECTS OF THE INVENTION

It is therefore an object of the invention to provide an improved galvanic or electrochemical corrosion prevention device.

It is another object of the invention to provide such a device which is less expensive to manufacture.

It is still another object of the invention to provide such a device which is less expensive to use and to replace.

SUMMARY OF THE INVENTION

These and other objects, features and advantages of the invention are accomplished by the corrosion preventing device for a marine propeller disclosed herein. A corrosion preventing device is disclosed for mounting in sea water on an electrically conductive propeller shaft supporting a marine propeller composed of a metal having a first galvanic potential. The propeller is fastened to the shaft by an electrically conductive propeller nut and is in electrical contact therewith. The device includes an annular washer having a generally circular periphery, composed of a metal having a second galvanic potential not greater than the first galvanic potential, with a central hole concentric with the circular axis thereof through which the shaft may fit to enable an electrically conductive mounting proximate to the propeller nut, for serving as an electrolytic cathode of the device. The device further includes a generally toroidal anode having a circular periphery concentric with the axis, composed of a metal having a third galvanic potential greater than the first galvanic potential, cast about the periphery of the annular washer and exposed to the sea water, for serving as an electrolytic, sacrificial anode of the device. In this manner, the galvanic cell formed by the washer cathode and the toroidal anode maintains the propeller at a relative cathodic potential, thereby preventing the corrosion thereof in the sea water. The resultant device is less expensive to make, use and replace than those in the prior art because its component parts require no machining in their manufacture and the device is fastened to the propeller shaft with a simple jam nut.

DESCRIPTION OF THE FIGURES

These and other objects, features and advantages of the invention will be more fully appreciated with reference to the accompanying figures.

FIG. 5 is a front view of a first embodiment of the washer.

FIG. 6 is a side view of the washer of FIG. 5.

FIG. 7 is a cross sectional view along section 7–7' of FIG. 2, showing a second embodiment of the washer within the anode casting.

FIG. 8 is a front view of the washer of FIG. 7.

FIG. 9 is a side view of the washer of FIG. 8.

FIG. 10 is a front view of a third embodiment of the washer.

FIG. 11 is a side view of the washer of FIG. 10.

DISCUSSION OF THE PREFERRED EMBODIMENT

Figures 1, 2, 3, 4:
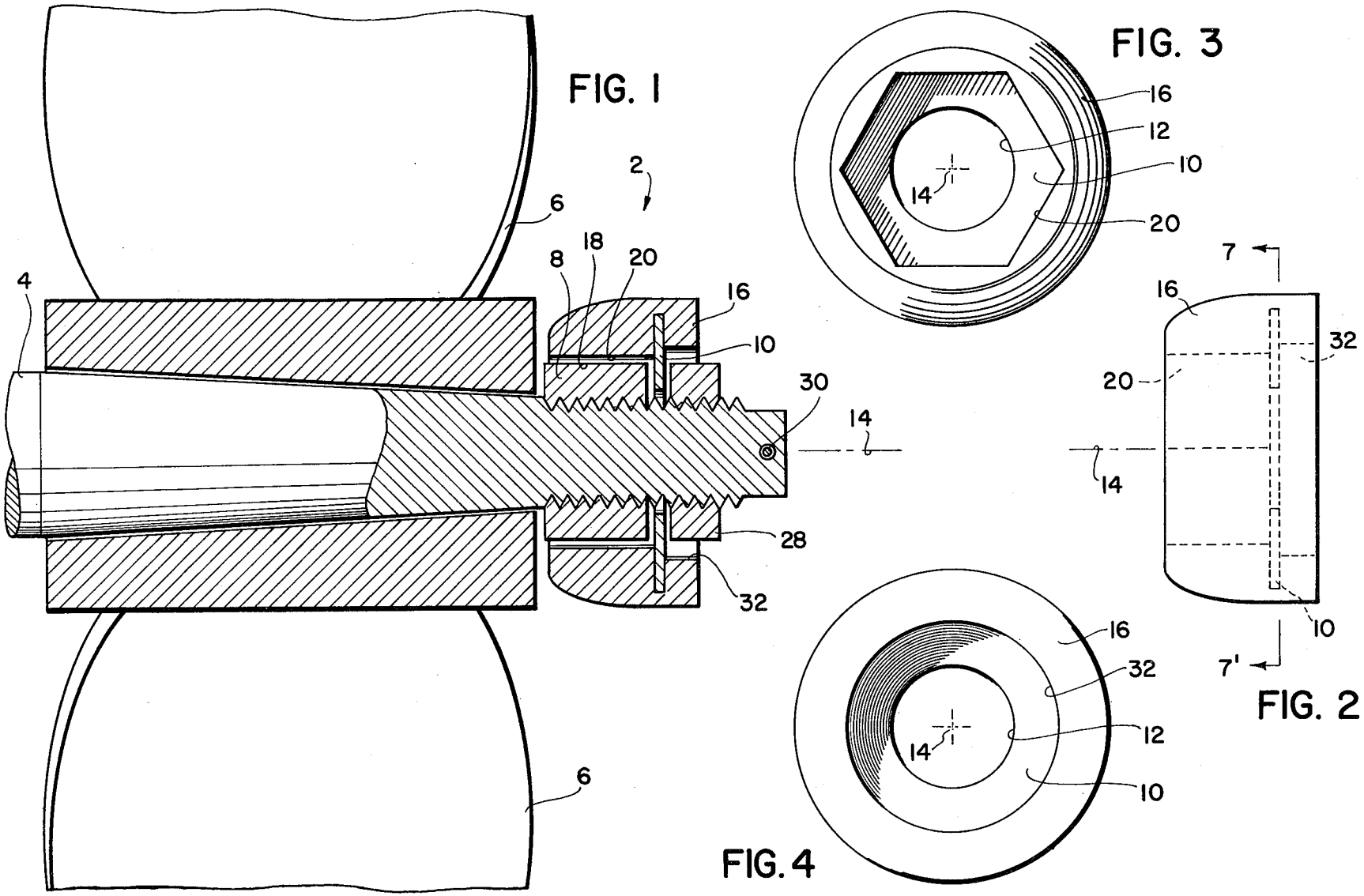
FIG. 1 is a side breakaway view of the invention assembled on a propeller shaft.
FIG. 2 is a side view of the invention.
FIG. 3 is a front view of the invention.
FIG. 4 is a rear view of the invention.

While corrosion can take any one of the several forms, the mechanism of attack in aqueous solutions involves some aspect of electrochemistry. There is a flow of electricity from certain areas of a metal surface to other areas through a solution capable of conducting electricity, such as seawater or hard water. This is called galvanic corrosion. The term "anode" is used to describe that portion of the metal surface which is corroded and from which current leaves the solution to return to the metal. The circuit is completed outside the solution through the metal or through a conductor joining two pieces of metal. Electricity (positive current) flows in the solution from the anode (−) to the cathode (+) and returns from the cathode to the anode through the metal. An electrolyte solution is capable of conducting electricity due to the presence of positively or negatively charged ions in solution. Even pure water contains positively charged hydrogen ions ($H^+$) and negatively charged hydroxyl ($OH^-$) in equal concentration. The electrolyte forming a corrosive environment may be any solution and can range from freshwater or saltwater to the strongest alkali or the strongest acid.

Anodic Processes take place at the anode when corrosion occurs. Positively charged atoms of metal leave the solid surface and enter into solution as ions. They leave their corresponding negative charges in the form of electrons which are able to flow through the metal or any external electric conductor. The ionized atoms can bear one or more positive charges. In the corrosion of zinc, each zinc atom becomes a zinc ion carrying two positive charges and generates two electrons. These electrons travel through the metal or an external electric conductor to complete the circuit at the cathode, where a corresponding reaction consumes these electrons. Cathodic processes take place at a cathode such as brass, in parallel with what has been going on at the zinc anode. The electrons generated by the formation of metallic ions at the anode have passed through the metal to the surface of the cathode areas immersed in the electrolyte. Here they restore the electrical balance of the system by reacting with and neutralizing positive ions such as hydrogen ions in the electrolyte. Hydrogen ions can be reduced to atoms, and these often combine to form hydrogen gas by such reaction with electrons at a cathode surface. This reduction of hydrogen ions at the cathode surfaces will disturb the balance between the acidic hydrogen $H+$ ions and the alkaline hydroxyl ($OH^-$) ions and make the solution less acid or more alkaline in this region.

Thus, for corrosion to occur there must be a formation of ions and release of electrons at an anodic surface, where oxidation or deterioration of the metal takes place. There must be a simultaneous acceptance of the cathodic surface of the electrons generated at the anode. This acceptance of electrons can take the form of neutralization of positive hydrogen ions or the formation of negative ions. The anodic and cathodic reactions must go on at the same time and at equivalent rates. But corrosion occurs only in the areas that serve as anodes.

Galvanic corrosion is frequently encountered on marine propellers because salt water is an excellent electrolyte. However, propellers made of copper and its alloys will rarely corrode galvanically if coupled with an anodic metal, because copper is cathodic to such metals as iron, zinc, aluminum, magnesium, lead, and tin.

Potentials develop between couples of copper and some of its alloys with other metals and alloys when immersed in a sea-water solution. Aluminum, iron, lead, nickel, tin and zinc are anodic to the copper-base materials. Laboratory tests of couples in this same type of solution have shown that the use of steel, wrought iron, aluminum, zinc and lead in combination with copper alloys is likely to result in severe damage of the non-copper alloy.

In couples of two different copper-zinc alloys, the alloy of higher zinc content is anodic, although the potentials developed are not large. Galvanic corrosion is uncommon when two copper alloys are coupled.

Table I gives a galvanic potential series of metals and alloys (*Metals Handbook*, American Society for Metals, 8th Ed., Vol. 1, 1961, page 987). Those metals grouped together may be coupled without significant galvanic corrosion. Connecting two metals from different groupings leads to corrosion of the metal on the anodic end of the list. Rate of corrosion will depend on the difference in potential and voltage of the two specific metals. As indicated in Table I, only a few metals are cathodic to copper alloys. This series is valid for dilute water solutions such as sea water.

TABLE I

GALVANIC POTENTIAL SERIES IN SEA WATER

Anodic End

| | |
|---|---|
| 1 Magnesium (most active) | 22 Lead |
| 2 Magnesium alloys | 23 Tin |
| 3 Zinc | 24 Muntz metal |
| | 25 Manganese bronze |

TABLE I-continued

GALVANIC POTENTIAL SERIES IN SEA WATER

Anodic End

| | |
|---|---|
| 4 Galvanized steel | 26 Naval brass |
| | 27 Nickel (active) |
| 5 Aluminum 5052H | 28 Inconel (active) |
| 6 Aluminum 3004 | 29 Cartridge brass |
| 7 Aluminum 3003 | 30 Admiralty brass |
| 8 Aluminum 1100 | 31 Aluminum bronze |
| 9 Aluminum 6053 | 32 Red brass |
| 10 Alclad | 33 Copper |
| 11 Cadmium | 34 Silicon bronze |
| | 35 Cupro-nickel, 30% |
| 12 Aluminum 2017 | |
| 13 Aluminum 2024 | |
| | 36 Nickel (passive) |
| 14 Mild Steel | 37 Inconel (passive) |
| 15 Wrought iron | |
| 16 Cast Iron | 38 Monel |
| 17 Ni-Resist | |
| 18 13% Cr stainless, type 410 (active) | 39 18-8 stainless, type 304 (passive) |
| | 40 18-8-3 stainless, type 316 (passive) |
| 19 50-50 lead-tin solder | |
| | 41 Silver |
| 20 18-8 stainless, type 304 (active) | 42 Gold |
| 21 18-8-3 stainless, type 316 (active) | 43 Platinum (least active) |
| | Cathodic End |

In pleasure craft and other relatively small boats, where their service is less critical than for naval vessels, merchant ships and harbor craft, propellers are commonly made of manganese and aluminum bronzes, stainless steels, aluminum alloys, and appropriate plastics. The nickel aluminum bronzes are preferred over manganese bronzes, especially for high performance boats where their higher strength permits the use of thinner sections and their superior resistance to erosion and cavitation damage is advantageous. Boats and hydrofoils operating at very high speeds and sometimes using what are called "supercavitating" propellers require materials that offer maximum resistance to cavitation erosion and the highest corrosion fatigue values. These requirements are met by titanium and by the Inconel 625 alloy in wrought form. The selection of appropriate sacrificial anodic materials to prevent galvanic corrosion of such propellers in accordance with the invention, can be done by reference to the galvanic potential series of Table I.

FIGS. 1, 2, 3, 4 and 7 show the invention which is the corrosion preventing device 2 for mounting in sea water on an electrically conductive, steel propeller shaft 4 supporting a marine propeller 6. The propeller 6 is composed of a metal having a first galvanic potential, the propeller 6 being fastened to the shaft 4 by an electrically conductive, steel propeller nut 8, and in electrical contact with the shaft and nut 8.

The device includes an annular washer 10 having a generally circular periphery, and is composed of a metal having a second galvanic potential not greater than the first galvanic potential of the propeller 6. The washer 10 has a central hole 12 concentric with the circular axis 14 thereof through which the shaft 4 may fit to enable the electrically conductive mounting of the washer 10 proximate to the propeller nut 8, for serving as the electrolytic cathode of the device.

The device further includes a generally toroidal molded anode 16 having a circular periphery concentric with the axis 14 and is composed of a metal having a third galvanic potential greater than the first galvanic potential of the propeller 6. The toroidal anode 16 is cast from molten metal about the periphery of the annular washer 10 and is exposed to the sea water, for serving as the electrolytic, sacrificial anode of the device.

In this manner, the galvanic cell formed by the washer cathode 10 and the toroidal anode 16 maintains the propeller 6 at a relative cathodic potential, thereby preventing the corrosion thereof in the sea water.

Although the washer 10 and anode 16 can be composed of any of the metals shown in Table I, as long as their relative galvanic potentials are as described above, in the preferred embodiment for brass marine propellers, the washer 10 is composed of brass and the anode 16 is composed of zinc.

As is shown in FIGS. 1 and 3, the stainless steel propeller nut 8 has a generally polygonal cross sectional shape and in particular a hexagonal shape is shown, with planar peripheral surfaces 18 parallel with the axis 14. The molded toroidal anode 16 has an internally cast hexagonal cavity 20 adapted to slidably fit over the propeller nut 8. In this manner, the device 2 compactly fits on the shaft 4.

In a first embodiment shown in FIGS. 5 and 6, the periphery of the washer 10 is a serrated edge 22 to enable a secure mechanical anchorage of the cast toroidal anode 16 to the washer 10. In this manner, angular accelerations of the shaft 4 and washer 10 will not loosen the toroidal anode 16. The washer 10 in this embodiment can be inexpensively made from a stamping of sheet brass.

In a second embodiment shown in FIGS. 7, 8 and 9, the washer 10 has a plurality of holes 24 therethrough about the periphery thereof to enable a secure mechanical anchorage of the cast toroidal anode 16 to the washer 10. In this manner, angular accelerations of the shaft 4 and washer 10 will not loosen the toroidal anode 16. The washer 10 in this embodiment can be inexpensively made from a stamping of sheet brass.

In a third embodiment shown in FIGS. 10 and 11, the washer 10 has a raised rim 26 about the periphery thereof, forming a generally cup-shaped surface with the rim being enveloped within the cast body of the anode 16. This will enable the washer 10 to contribute its radial tensile strength to that of the toroidal anode 16 so that it can withstand the higher centrifugal forces when used with high speed racing propellers. The washer 10 in this embodiment can be inexpensively made from a brass stamping which has then been put through a deep-drawing operation.

As is shown in FIG. 1, the device 2 is secured to the shaft 4 by means of a conventional, stainless steel jam nut 28 threaded onto the shaft 4. The jam nut 28 exerts axial force against the washer 10 to ensure mechanical and electrical contact between the washer 10 and the propeller nut 8. The shaft 4 includes a steel cotter pin 30 transversely mounted in a hole through the shaft 4 for preventing the jam nut 28 from loosening. The jam nut 28 may be a castellated nut, if so desired. The jam nut is meant to be a commonly available inexpensive, threaded, stainless steel nut and serves as the principal fastening element for the corrosion preventing device 2 to the shaft 4. In this manner, no threaded surfaces need to be machined on the device 2, thereby minimizing its manufacturing cost.

As is shown in FIGS. 1, 2 and 4, the molded toroidal anode 16 has a cylindrical recess 32 molded on the opposite side with respect to the cavity 20 and coaxial with the axis 14, for receiving the jam nut 28.

The resulting corrosion prevention device is less expensive to manufacture, use and replace than the devices of the prior art. No machining of its component parts is necessary since the washer 10 is stamped from sheet brass and the anode 16 is cast around the washer from molten zinc metal. The device needs no threaded surfaces because a conventional jam nut 28 fastens the device to the shaft.

Although specific embodiments of the invention have been disclosed, it should be understood by those having skill in the art that minor changes can be made in the structures and materials disclosed without departing from the spirit and scope of the invention.

What is claimed is:

1. A corrosion preventing device for mounting in sea water on an electrically conductive propeller shaft supporting a marine propeller composed of a metal having a first galvanic potential, the propeller being fastened to the shaft by an electrically conductive propeller nut, and in electrical contact therewith, comprising:

an annular washer having a generally circular raised rim about the periphery thereof forming a generally cup-shaped surface, composed of a metal having a second galvanic potential not greater than said first galvanic potential, with a central hole concentric with the circular axis thereof through which said shaft may fit to enable electrically conductive mounting proximate to said propeller nut, for serving as an electrolytic cathode of the device;

a generally torroidal anode having a circular periphery concentric with said axis, composed of a metal having a third galvanic potential greater than said first galvanic potential, cast about said rim on the periphery of said annular washer and exposed to said sea water, for serving as an electrolytic, sacrificial anode of the device;

said rim of said annular washer providing centripetal support to said torroidal anode to prevent the anode from mechanical disintegration during rotation at high angular velocities while the anode is in a state of protracted sacrificial corrosion.

2. The device of claim 1, wherein said washer is composed of brass and said anode is composed of zinc.

* * * * *